United States Patent [19]

Chen

[11] 4,070,993

[45] Jan. 31, 1978

[54] PRE-ENGINE CONVERTER

[75] Inventor: Nai Yuen Chen, Titusville, N.J.

[73] Assignee: Mobil Oil Corporation, New York, N.Y.

[21] Appl. No.: 758,249

[22] Filed: Jan. 10, 1977

Related U.S. Application Data

[63] Continuation of Ser. No. 585,225, June 9, 1975, abandoned.

[51] Int. Cl.[2] ..... F02M 25/06

[52] U.S. Cl. ..... 123/3; 48/107; 48/212

[58] Field of Search ..... 123/1 A, 3, 119 E; 48/107, 212

[56] References Cited

U.S. PATENT DOCUMENTS

| | | | |
|---|---|---|---|
| 3,635,200 | 1/1972 | Randell et al. | 123/3 |
| 3,828,736 | 8/1974 | Koch | 123/3 |
| 3,855,980 | 12/1974 | Weisz et al. | 123/3 |
| 3,897,225 | 7/1975 | Henkel et al. | 123/3 |
| 3,915,125 | 10/1975 | Henkel et al. | 123/3 |

*Primary Examiner*—Charles J. Myhre
*Assistant Examiner*—David D. Reynolds
*Attorney, Agent, or Firm*—Charles A. Huggett; Ronald J. Cier

[57] ABSTRACT

In pre-engine converters, a low octane fuel is contacted with a catalyst bed at high temperature cracking conditions to produce a gaseous product of substantially higher octane which is then fed, together with air, directly to an internal combustion engine. This improvement mixes oxygen with the fed fuel and uses a ZSM-5 zeolite alone or mixed with an oxidation catalyst for the conversion.

7 Claims, 2 Drawing Figures

PRE-ENGINE CONVERTER

CROSS-REFERENCE TO RELATED APPLICATION

This application is a continuation of copending application Ser. No. 585,225 filed June 9, 1975 now abandoned.

BACKGROUND OF THE INVENTION

1. Field of the Invention

This invention relates to pre-engine converters. It more particularly refers to means for supplying the heat necessary to support the endothermic nature of their operation.

2. Description of the Prior Art

Pre-engine converters are known in the internal combustion engine art. Their purpose is to supply a high octane fuel to an internal combustion engine by converting a low octane number fuel in the fuel tank to light, normally gaseous hydrocarbons. Patents directed to this technology have been issued at least as early as 1940. Many different catalysts have been disclosed in the patent literature including various zeolites such as Y and ZSM-5. Pertinent patents include: U.S. Pat. Nos. 3,855,980; 3,635,200 and 2,201,965. There may be others but these three seem to represent the state of the art.

All of these references have in common the feeding of low octane fuel over a cracking catalyst to produce a product comprising a light, high octane gas. Explicit or implicit in the state of the art is the desire to exclude air (or other oxygen-containing fluids) from the conversion zone so as not to precombust fuel and therefore reduce the amount of fuel available for burning in the engine.

Most of the prior art recognize that two significant problems exist with pre-engine converters; cold start operation and catalyst regeneration. As to the first, hydrocarbon cracking is a substantially endothermic process requiring a continual source of heat to support catalytic cracking activity. In refineries, catalytic cracking is carried out at about 900° F. The heat necessary to support cracking is often supplied by burning residual coke off catalyst. Thus in a fluid catalytic cracking process, hot, fresh or regenerated cracking catalyst is contacted with oil to be cracked. As the oil is cracked, it cools the catalyst and deactivates it by forming a layer of coke thereon. The cracked oil is separated from the coked catalyst which is then regenerated by burning off the coke which reheats the catalyst. These processes are continuous with very infrequent shut downs. Thus, there are few "cold starts." After a shut down, however, start up usually requires external heating of catalyst inventory at least to an extent necessary to initiate cracking so as to start the cycle. Thus, it is seen that in a refinery, supplying endothermic heat for the cracking reaction and regenerating the spent catalyst are complementary operations.

In a pre-engine converter, however, the cracking system employed uses a fixed catalyst bed rather than an FCC type system and is subjected to many, many cold starts, at least once a day on the average and in many cases substantially more often. Confronting these two problems within the constrains of operation set forth above and coupled with the fact that under cold start conditions, it is not even practical to attempt to burn off coke on catalyst to generate start up heat, the prior art has consistently suggested external heat sources. These include, obviously, electric heating with energy supplied by the car battery which may be quite suitable for cold starts and for running even after warm up. They have also included using the heat in exhaust gases (in the exhaust manifold for example), for running after the engine is warmed up. It has also been proposed to solve the catalyst regeneration problem by burning off the deposited coke with air. This usually took place in an operation separate from and alternating with converting. Thus, one suggestion was to use a swing reactor system with one catalyst bed converting and another regenerating, perhaps simultaneously. Another suggestion has been to operate one catalyst bed alternatively on conversion and regeneration cycles. Still, other suggestions have included using a pre-engine converter only during high load demand situations. Alternatively, proposals have been made to thermostatically control the operation of a pre-engine converter so that it only operated after the engine had warmed up to a sufficient extent.

While the generic concept of a pre-engine converter is on its face a desirable thing, in that it reduces the need for refining petroleum with its attendant yield losses and reduces or eliminates the need for octane appreciators, such as alkyl lead compounds, it has certain inherent deficiencies which have not yet been overcome. In particular, it is recognized by all that such a converter is a small in situ cracker which operates endothermically. Therefore, some means must be provided for operation under cold start conditions. The usual proposed solution to this problem is to heat the system electrically. Based on operating conditions of 900° F and a space velocity of 20 LHSV, and assuming a warm up time of 1 minute, which is admittedly probably too long for practical application, the power input required would be 15 kw. This is too great a strain on the battery system of an ordinary passenger car as currently contemplated.

The alternative to this has been the proposal for a dual fuel system, a high octane one for start-up and a cruder fuel for steady state use. As a practical matter, this is an undesirable solution since it requires major modification of the fuel system existent in modern automobiles.

At noted above, catalysts for pre-engine conversions have been disclosed to be conventional cracking catalysts such as zeolite Y. Unconventional zeolite catalysts which have cracking activity, such as ZSM-5 zeolites, have been disclosed and claimed elsewhere for this use.

SUMMARY OF THE INVENTION

The device of this invention is a pre-engine catalytic converter, intended for use in conjunction with an internal combustion engine, which overcomes the cold-start problems of conventional pre-engine converters while providing improved octane enhancement of the fuel. The device contains a specific type of zeolite catalyst (ZSM-5), preferably in admixture with an oxidation component, and has provision for mixing a controlled amount of an oxygen-containing gas with the low octane, normally liquid hydrocarbon fuel before it contacts the catalyst. The amount of oxygen-containing gas mixed with the fuel is sufficient to burn a controlled portion of the fuel within the device, thereby quickly bringing the catalyst to effective cracking temperature. Once the catalyst has reached the desired temperature the amount of oxygen-containing gas admitted is adjusted by appropriate valving means, in conjunction with appropriate temperature sensing control means, to maintain the device at operating temperature by burning only a small portion of the fuel intermittently and/or constantly.

It is an object of this invention to provide a novel catalytic pre-engine converter system.

It is another object of this invention or provide a new technique for operating a pre-engine converter system.

Other and additional objects of this invention will become apparent from a consideration of this entire disclosure including the claims hereof.

BRIEF DESCRIPTION OF THE DRAWINGS

Understanding of this invention will be facilitated by reference to the accompanying drawing in which.

DESCRIPTION OF THE PREFERRED EMBODIMENTS

Figure 1:
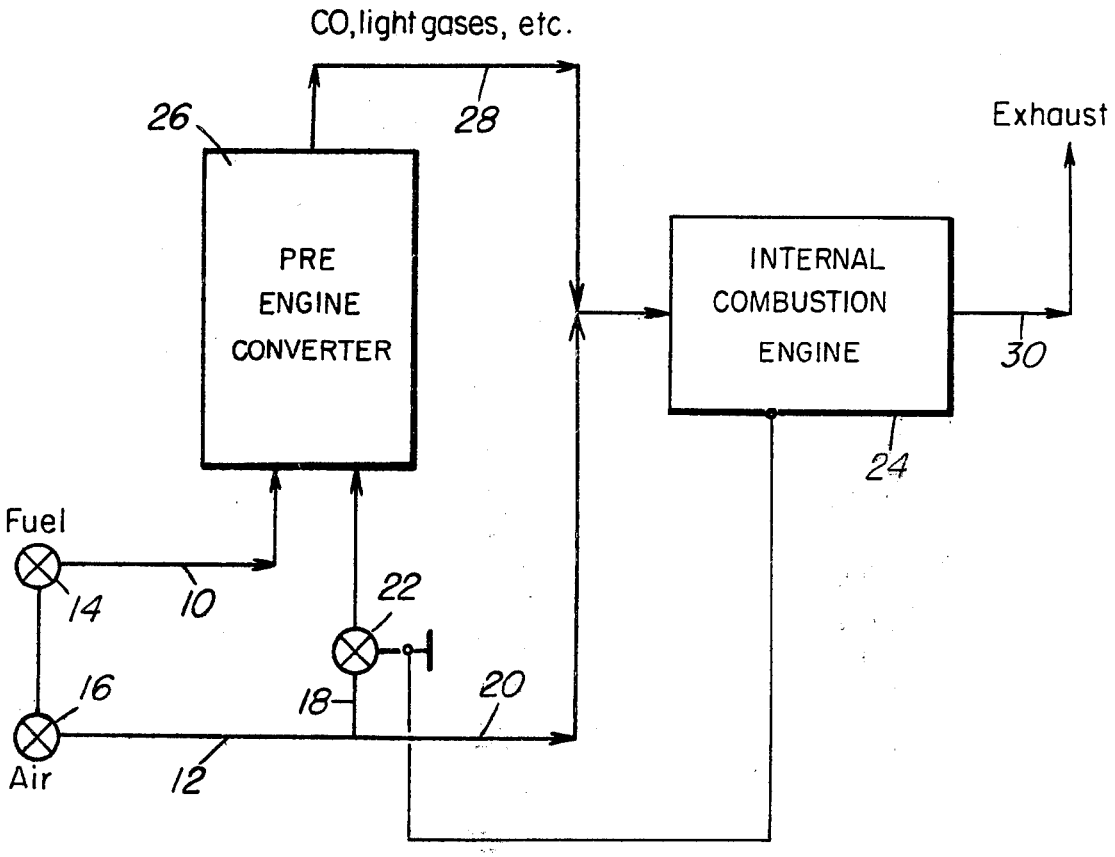
FIG. 1 is a schematic representation of the process and apparatus of this invention.

Fuel 10 and air 12 are fed through conventional stoichiometry metering means 14 and 16. The air is split into two streams 18 and 20 with the amount of the side stream 18 controlled by a thermostat valve 22. The thermostat is controlled from an internal combustion engine 24. The fuel 10 and the air stream 18 are cofed to a pre-engine converter 26 where the fuel is partially burned and partially converted to lighter products. This gas mixture 28 is mixed with the air stream 20 and fed to the internal combustion engine 24 where powder is produced as is an exhaust gas 30.

Figure 2:
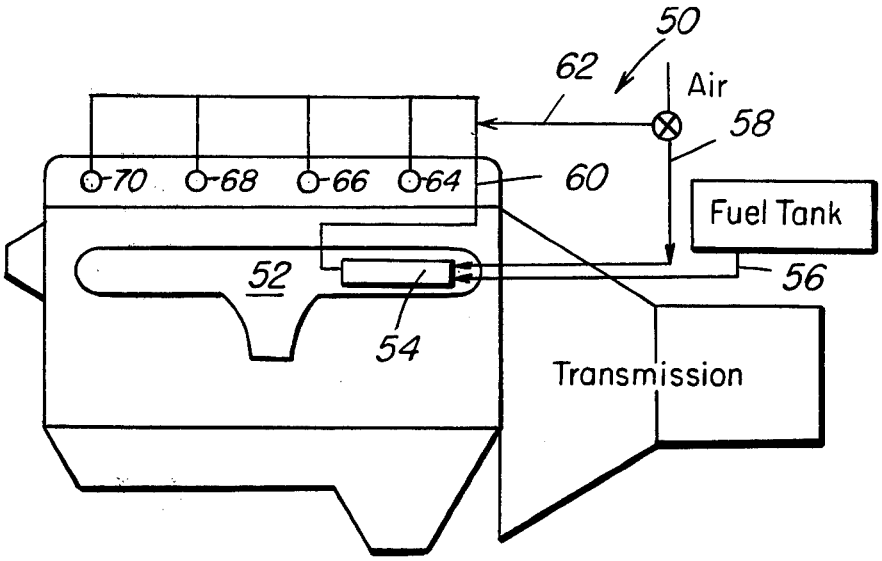
FIG. 2 is a pictorial representation of a gasoline engine utilizing a fuel injection system and a pre-engine converter.

Referring now to FIG. 2, a conventional internal combustion engine 50 is suitably modified by removing the traditional carburetor. The exhaust manifold 52 is modified to incorporate a pre-engine converter 54 therein. These are provided means for feeding fuel 56 to the converter and means for feeding air 58 to the converter 54. The converted fuel 60 leaves the converter, is admixed with air 62 and fed to the engine 50 via injectors 64, 66, 68 and 70.

A substantial requirement of the novel operation of a pre-engine converter according to this invention is that it uses a catalyst comprising a special zeolite. Members of this special class of zeolites exhibit some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful in type B catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e, they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted to between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| TMA Offretite | 3.7 |
| ZSM-12 | 2 |
| Beta | 0.6 |
| ZSM-4 | 0.5 |
| H-Zeolon | 0.5 |
| REY | 0.4 |
| Amorphous Silica-alumina | 0.6 |
| Erionite | 38 |

The above-described Constraint Index is an important, and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the parameter and property "Constraint Index" as such value is used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, and other similar materials. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. Application, Ser. No. 358,192, filed May 7, 1973, the entire contents of which are incorporated herein by reference, describes a zeolite composition, and a method of making such, designated as ZSM-21 which is useful in this invention. Recent evidence has been adduced which suggests that this composition may be composed of at least two (2) different zeolites, one or both of which are the effective material insofar as the catalysis of this invention is concerned. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air of about 1000° F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April, 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the preview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5,-11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

According to one aspect of this invention the pre-engine converter catalyst may also have an oxidation catalyst admixed with the special zeolite. Such oxidation catalysts are heterogeneous as is the zeolite and may for example be platinum on alumina. Other exemplary oxidation catalysts are various transition metals including vanadium.

Fuel, preferably low octane fuel such as straight run, virgin naphtha, which may contain components boiling higher than the normal gasoline boiling range, is mixed with a stoichiometric deficiency of an oxygen containing gas such as air and the mixture passes in contact with the catalyst. A portion of the fuel burns to generate heat sufficient to sustain the cracking operation taking place in the converter. The rest of the fuel is cracked to lighter gases which are then mixed with supplemental oxygen and fed by conventional means to the intake of an internal combustion engine.

It is within the spirit and scope of this invention to provide means for heating the pre engine converter other than by partial oxidation of the fuel, such as for example by heat exchange with exhaust gases once the engine has warned up sufficiently. In this regard, it is suitable to provide thermostat means to control the air (oxygen) input to the pre-engine converter so as to reduce air input proportional to rising engine temperature. Thus, one suitable technique for practicing this invention is to separately meter fuel and air in a proper proportion to satisfy the requirements of the engine. The properly proportioned air stream is provided with a thermostatically valved slip stream. The slip stream and the fuel are fed to the pre-engine converter and the main air stream is mixed with the product from the converter and fed to the engine. in this way the total fed air remains properly determined by fuel fed to the engine but the air fed to the converter is determined by heat requirements.

It is interesting to note that while it might at first appear obvious to satisfy the heat requirements of the pre-engine conversion system by partial oxidation of the fuel feed, prior workers in the field have not suggested this and in fact have in some patent claims included proscriptions thereof. It is of interest to note that attempts to supply heat to a pre-engine converter in this manner, that is by partial feed oxidation, using relatively conventional zeolite hydrocarbon cracking catalysts, such as Zeolite Y, have proved to be inadequate in that the catalyst becomes deactivated very rapidly. In marked contrast to these findings, the special zeolites set forth above to be useful in this invention have shown no substantial diminution of activity, over the same time on stream. The additional incorporation of an oxidation catalyst along with the special zeolite has resulted in improved initial conversions and has not been subjected to marked conversion diminution over short on stream times.

EXAMPLES

The following Examples are illustrative of the practice of this invention without being limiting on the scope thereof. They also show comparative data which evidence invention. Parts and percentages are by weight unless expressly stated to be on some other basis. In each set of runs, the hydrocarbon portion of the feed was simulated low octane naphtha and constituted a mixture of 48.19% n-heptane, 27.76% n-octane and 25.06% toluene. It was fed over the catalyst bed at a rate of 0.75 gram per 10 minutes along with air cofed at a rate of 50 cubic centimeters per minute. Space velocity was 0.9 WHSV. In each run, 5 grams of catalyst were used. The catalyst had a particle size of 30/70 mesh. Each run set was broken down into three consecutive 10 minute cycles with no catalyst regeneration between cycles. This was to simulate taking three consecutive short trips in a car.

| | | | |
|---|---|---|---|
| **Run set 1** | | | |
| Catalyst - conventional FCC cracking catalyst (rare earth exchanged zeolite Y) | | | |
| Cycle | 1 | 2 | 3 |
| Feed (gms) | 2.11 | 2.22 | 2.33 |
| Conversion to $C_5^-$ gases and coke (%) | 88.6 | 66.2 | 13.5 |
| Coke on catalyst at end of run set | | | 1.04 grams |
| **Run set 2** | | | |
| Catalyst - H-ZSM-5 | | | |
| Cycle | 1 | 2 | 3 |
| Feed (gms) | 2.20 | 2.23 | 2.21 |
| Conversion to $C_5^-$ gases and coke (%) | 57.8 | 56.1 | 57.4 |
| Coke on catalyst at end of run set | | | 0.52 grams |
| **Run set 3** | | | |
| Catalyst - 50% each mixture of the catalyst of Run set 1 and a platinum on alumina oxidation catalyst | | | |
| Cycle | 1 | 2 | 3 |
| Feed (gms) | 2.11 | 2.24 | 2.22 |
| Conversion to $C_5^-$ gases and coke (%) | 73.0 | 33.0 | 29.5 |
| Coke on catalyst at end of run set | | | 0.86 grams |
| **Run set 4** | | | |
| Catalyst - 50% each mixture of H-ZSM-5 and the same oxidation catalyst as used in Run set 3. | | | |
| Cycle | 1 | 2 | 3 |
| Feed (gms) | 2.22 | 2.21 | 2.30 |
| Conversion to $C_5^-$ gases and coke (%) | 61.3 | 61.1 | 64.3 |
| Coke on catalyst at end of run set | | | 0.36 grams |

EXAMPLE 5

This Example 5 was conducted identically to Run set 3 except that the cofed air was replaced by an equivalent amount of helium. The total feed was 2.22 grams. Conversion to $C_5^-$ gases and coke was 14%.

The conventional cracking catalyst produced the highest coke on catalyst buildup, and conversion to $C_5^-$ gases decreased rapidly with time on stream as evidenced by the data in Run Set 1. Surprisingly when Run Sets 1 and 2 are compared, it is found that while conversion using conventional cracking catalyst substantially diminished in a short time, conversion with the special zeolite of this invention is substantially unaffected during the same time period.

Since it has been believed by the art that the inclusion of an oxidant during cracking would increase coke deposition on the catalyst and would thereby be expected to reduce conversion, (this belief is substantiated by the data shown in Run Set 1 for a conventional cracking catalyst), the results achieved with the instant special zeolite catalyst as shown in Run Set 2 are most unexpected and surprising.

Adding an oxidation catalyst converted a portion of the fuel to combustion products and heat as expected and also reduced coke buildup, but in the case of conventional cracking catalyst the presence of an oxidation catalyst also substantially reduced the conversion to gaseous hydrocarbons more rapidly than in the absence of an oxidation catalyst. This low conversion was further confirmed by the results of the fourth cycle in which helium was used instead of air to nullify the effect of the oxidation catalyst. As shown by the data in Example 5 the conversion to $C_5^-$ gases and coke during the fourth cycle was less than 14%.

It is further surprising that, contrary to the results achieved by adding an oxidation catalyst to conventional cracking catalyst, adding an oxidation catalyst to the special zeolite catalyst of this invention actually increased conversion while reducing coke make.

When Run Sets 2 and 4 are compared, it is found that the increased conversion by the addition of an oxidation catalyst is attributable to the conversion of the fuel to combustion products and heat, and the conversion to gaseous hydrocarbons was not adversely affected by the presence of an oxidation catalyst.

What is claimed is:

1. In the process of converting low octane normally liquid hydrocarbons to higher octane normally gaseous hydrocarbons by contacting said liquid hydrocarbons with a hydrocarbon cracking catalyst under cracking conditions, mixing the resulting gaseous hydrocarbon product with an oxygen-containing gas, and generating power by burning said gaseous hydrocarbon with said oxygen in an internal combustion engine; the improvement which comprises contacting said low octane normally liquid hydrocarbons with a controlled amount of an oxygen-containing gas in the presence of a hydrocarbon cracking catalyst, said controlled amount of said oxygen-containing gas being an amount sufficient to burn only a portion of said liquid hydrocarbons and provide a gaseous effluent comprising hydrocarbons of higher octane value than said normally liquid hydrocarbons, and said hydrocarbon cracking catalyst comprising a crystalline aluminosilicate zeolite having a silica to alumina ratio of at least 12, a constraint index of 1 to 12 and a crystal density not substantially below about 1.6 grams per cubic centimeter; mixing the resultant gaseous hydrocarbon effluent with an oxygen-containing gas in amount sufficient to burn said gaseous hydrocarbons; and passing the resulting mixture of gaseous hydrocarbons and oxygen-containing gas to said internal combustion engine.

2. The improved process claimed in claim 1 wherein said low octane normally liquid hydrocarbons is straight run naphtha.

3. The improved process claimed in claim 1 wherein said zeolite is ZSM-5.

4. The improved process claimed in claim 1 wherein said catalyst additionally contains an oxidation catalyst component.

5. A pre-engine converter comprising a reactor chamber; a zeolite catalyst therein, said zeolite having a silica to alumina ratio of at least 12, a constraint index of 1 to 12 and a crystal density of not substantially below about 1.6 grams per cubic centimeter; means for feeding a low octane number normally liquid hydrocarbon to said chamber; means for feeding to said hydrocarbon feed an oxygen-containing gas in about stoichiometric proportions for burning said hydrocarbon feed; means for splitting said oxygen-containing gas into a controlled portion stoichiometrically sufficient to burn only a portion of said hydrocarbon feed, means for mixing said controlled portion of oxygen-containing gas with said hydrocarbon feed to be contacted with said catalyst in said chamber; means for withdrawing from said chamber a product stream comprising gaseous light hydrocarbons of higher octane number and combustion products of said feed hydrocarbons; means for mixing said product stream with the remainder of said oxygen-containing gas; and means for feeding the resulting mixture containing the remainder of the oxygen-containing gas to an internal combustion engine.

6. A pre-engine converter as claimed in claim 5 including thermostat means to control the proportion of oxygen-containing gas to be mixed with the liquid hydrocarbon feed to be contacted with the catalyst-containing chamber and which thermostat is a function of said engine temperature.

7. A pre-engine converter as claimed in claim 5 including an oxidation catalyst in said chamber.

* * * * *